US009984835B2

(12) United States Patent
Dolezalek et al.

(10) Patent No.: US 9,984,835 B2
(45) Date of Patent: May 29, 2018

(54) IMPACT ABSORBING UNITARY COVER ASSEMBLY

(71) Applicant: Banner Engineering Corp., Plymouth, MN (US)

(72) Inventors: Charles Dolezalek, Stacy, MN (US); Maximilian John Aponte, Shakopee, MN (US)

(73) Assignee: Banner Engineering Corp., Plymouth, MN (US)

( * ) Notice: Subject to any disclaimer, the term of this patent is extended or adjusted under 35 U.S.C. 154(b) by 0 days. days.

(21) Appl. No.: 15/254,564

(22) Filed: Sep. 1, 2016

(65) Prior Publication Data

US 2018/0061595 A1 Mar. 1, 2018

(51) Int. Cl.

| | |
|---|---|
| ***H01H 13/06*** | (2006.01) |
| ***H01H 13/46*** | (2006.01) |
| ***H01H 13/14*** | (2006.01) |
| ***H01H 23/06*** | (2006.01) |

(52) U.S. Cl.

CPC ..... *H01H 13/06* (2013.01); *H01H 13/14* (2013.01); *H01H 13/46* (2013.01); *H01H 23/06* (2013.01)

(58) Field of Classification Search

CPC ..... H01H 13/06; H01H 23/06; H01H 13/46; H01H 13/14

USPC ..... 200/302.1–302.3

See application file for complete search history.

(56) References Cited

U.S. PATENT DOCUMENTS

| | | | | |
|---|---|---|---|---|
| 4,885,443 | A | 12/1989 | Simcoe et al. | |
| 5,063,277 | A * | 11/1991 | Takano | H01H 13/06 200/302.2 |
| 7,282,657 | B2 * | 10/2007 | Wimmer | B29C 45/16 200/302.1 |
| 7,952,042 | B2 * | 5/2011 | Coomer | F16J 3/041 200/293 |

FOREIGN PATENT DOCUMENTS

| | | | | |
|---|---|---|---|---|
| EP | 2568490 A2 * | 3/2013 | | H01H 9/04 |

OTHER PUBLICATIONS

Rockwell Automation Inc., 30.5 mm Push Buttons, Industrial Controls Catalog, Aug. 2011, p. 10-39, Rockwell Automation, Milwaukee WI.

(Continued)

*Primary Examiner* — Edwin A. Leon
*Assistant Examiner* — Lheiren Mae A Caroc
(74) *Attorney, Agent, or Firm* — Craige Thompson; Thompson Patent Law

(57) ABSTRACT

Apparatus and associated methods relate to a cover assembly having a plurality of ribs integrally formed within an actuator body envelope to increase the resilience of the actuator body envelope against high-pressure water cleaning. In an illustrative example, the actuator body envelope defines an actuator body chamber while an actuator envelope integrally formed with the actuator body envelope defines an actuator chamber. The actuator chamber and the actuator body chamber may adapt to receive an actuator via an insertion aperture at a proximal end of the body envelope. In some implementations, the plurality of ribs may advantageously increase the service life of the cover assembly.

15 Claims, 7 Drawing Sheets

(56) References Cited

OTHER PUBLICATIONS

Schneider Electric, Automation & Control Components for the Food & Beverage Industry: The essential guide, Sep. 2007, Schneider Electric Industries, Rueil-Malmaison France.
Technor, Harmatex components, Catalogue 2015, May 2014, pp. 72-75, Marechal Electric Group, Saint-Maurice France.
Elobau, Emergency stop button, Machine Safety Catalogue, p. 118, [online], [Retrieved on Sep. 13, 2015]. Retrieved from: <URL: http://www.elobau.com/en-us/downloadcenter>.
Sprecher+Schuh, D7 Pilot Devices, Industrial Control + Protection Catalog, 2014, p. H71, Houston, TX.
Grainger, General Catalog, [online], [Retrieved on Sep. 13, 2015]. Retrieved from the Internet <URL: https://www.grainger.com/product/SIEMENS-Boot-41H021>.

* cited by examiner

IMPACT ABSORBING UNITARY COVER ASSEMBLY

TECHNICAL FIELD

Various embodiments relate generally to protection covers for actuators.

SUMMARY

Apparatus and associated methods relate to a cover assembly having a plurality of ribs integrally formed within an actuator body envelope to increase the resilience of the actuator body envelope against high-pressure water cleaning. In an illustrative example, the actuator body envelope defines an actuator body chamber while an actuator envelope integrally formed with the actuator body envelope defines an actuator chamber. The actuator chamber and the actuator body chamber may adapt to receive an actuator via an insertion aperture at a proximal end of the body envelope. In some implementations, the plurality of ribs may advantageously increase the service life of the cover assembly.

Various embodiments may achieve one or more advantages. For example, some embodiments may provide an increased service life of the cover assembly due to the impact absorbing areas of the cover assembly formed in response to the ribs. The ribs may provide air channels to facilitate the removal of the cover assembly from an actuator. The cover assembly may be constructed of a flexible material to facilitate the installation of the cover assembly over an actuator.

A translucent material may form the cover assembly. The translucent material may permit a user to easily see indicator lights on an actuator. As such, the user may easily identify the state of the actuator without the need to remove the cover assembly. The cover assembly may be formed of a transparent elastomeric silicone to provide transparency and hygienic characteristics. In various embodiments, a non-toxic material may form the cover assembly for use in a food processing area.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, an exemplary cover assembly having ribs is briefly introduced with reference to FIG. 1. Second, with reference to FIGS. 2A-4, the discussion turns to exemplary embodiments that illustrate a cover assembly having ribs. Specifically, the ribs integrally formed within a body of the cover assembly to provide protection against high-pressure water cleanings. Finally, with reference to FIG. 5, further embodiments of the exemplary cover assemblies are discussed.

Figure 1:
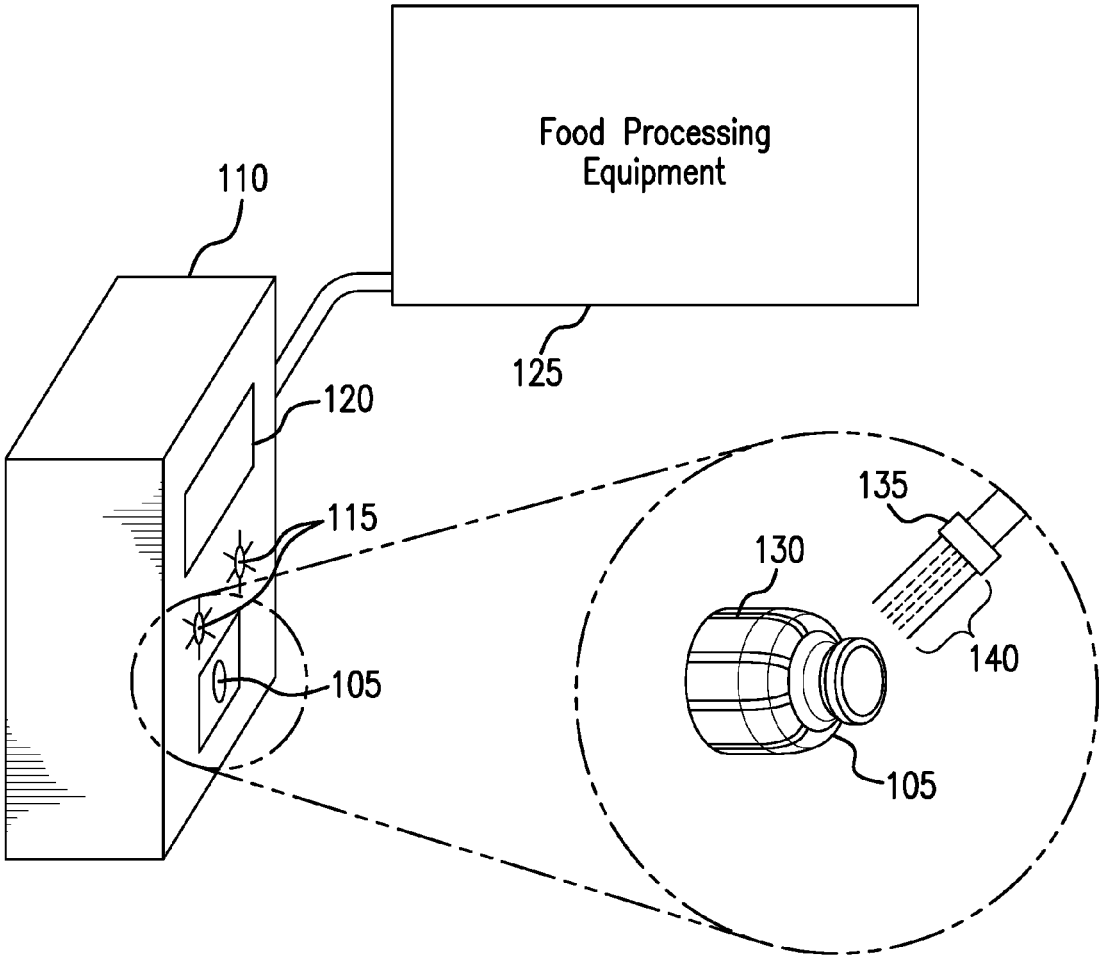
FIG. 1 depicts a perspective view of a control station having an exemplary actuator cover assembly.

FIG. 1 depicts a perspective view of a control station having an exemplary actuator cover assembly. A cover assembly 105 encloses an actuator (not shown) that operably attaches to the control station 110. The control station 110 includes a pair of rotating switches 115 and a display panel 120. The control station 110 operably connects to industrial equipment such as food processing equipment 125, for example. The cover assembly 105 includes ribs 130 longitudinally and radially extending inward from an interior surface of the cover assembly 105. A water hose 135 sprays high pressured water 140 towards the cover assembly 105. The ribs 130 may permit the cover assembly 105 to cushion the high pressured water 140 as it contacts the cover assembly 105 to prevent ripping of the cover assembly 105.

In various embodiments, the cover assembly 105 may be formed from a flexible material. The flexible material may allow the cover assembly 105 to expand to facilitate installation of the cover assembly 105 over an electrical device, such as an actuator, for example. The cover assembly 105 may releasably couple to the actuator to permit a user to remove the cover assembly 105 in the event that it is not needed. The cover assembly 105 may facilitate the removal of the cover assembly 105 in the event direct access is needed to an actuator for maintenance or to replace the actuator, for example. The cover assembly 105 may provide characteristics desired in an environment that requires sanitation using high temperature, high-pressure fluid, such as a cleaning solution or solvent, for example. A user may more easily replace the cover assembly 105 in the event the cover assembly 105 becomes compromised.

Figure 2A:
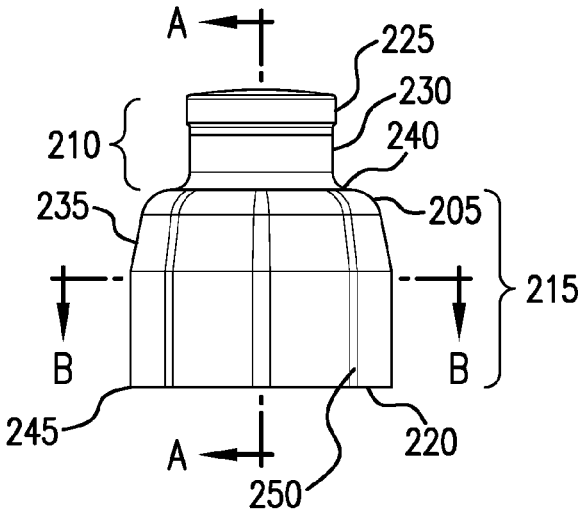
FIG. 2A depicts a side view of an exemplary cover assembly.

FIG. 2A depicts a side view of an exemplary cover assembly. The cover assembly 205, as depicted, integrally forms an actuator envelope 210, an actuator body envelope 215 and a sealing envelope 220. The actuator envelope 210 rests on the actuator body envelope 215. The actuator envelope 210 includes an upper rim 225 integrally formed on top of a first cylindrical body 230 to define a mushroom-type shape. The actuator body envelope 215 includes a substantially cylindrical body 235 that extends proximally from the actuator envelope. The cylindrical body 235 has a first diameter 240 at a distal end where the actuator envelope 210 meets the actuator body envelope 215. The cylindrical body 235 has a second diameter 245 at a proximal end where the actuator body envelope 215 meets the sealing envelope 220. A rib 250 extends from the first diameter 240 to the second diameter 245. A throat forms between the upper rim 225 and the actuator body envelope 215.

The actuator envelope 210 and the actuator body envelope 215 may form a cover assembly 205 having a unitary substantially smooth exterior of the cover assembly 205. The unitary substantially smooth exterior may facilitate removal of foreign particles during a high-pressure wash. The substantially smooth exterior may be substantially free of crevices that may prevent removal of foreign particles during a high-pressure wash.

Figure 2B:
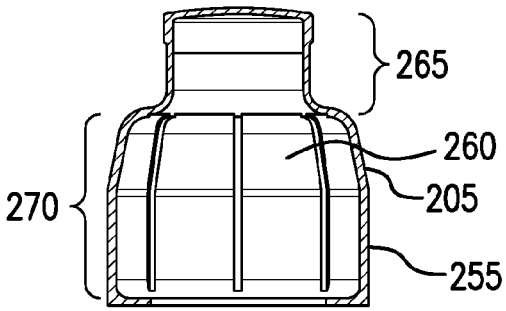
FIG. 2B depicts a side cross-section view of an exemplary cover assembly.

FIG. 2B depicts a side cross-section view of an exemplary cover assembly. As depicted, the side cross-section of the cover assembly 205 is from section A-A of FIG. 2A. A wall 255 of the cover assembly 205 defines a cavity 260. The actuator envelope 210 defines an actuator chamber 265 of the cavity 260 while the actuator body envelope 215 defines an actuator body chamber 270 of the cavity 255.

In some embodiments, the cover assembly 205 may be formed in different shapes and sizes to accommodate a greater range of actuators. The cover assembly 205 may include a substantially square actuator body chamber 270 to accommodate an actuator having a rectangular shaped enclosure. The wall 255 may be translucent to allow an indicator on an actuator to be seen through the wall 255. The cover assembly 205 may be constructed of a synthetic rubber, such as chlorosulfonated polyethylene, for example, to increase resistance of the cover assembly 205 against concentrated sulfuric acids.

In an illustrative example, a silicone material forms the cover assembly 205. The silicone material may increase resistance to high temperature. The silicone material may also provide protection against organic acids or vegetable oils. The silicone material may increase resistance to environmental effects, such as oxidation, for example. The silicone material may be non-toxic to provide a hygienic cover assembly 205 for use in food processing areas.

Figure 2C:
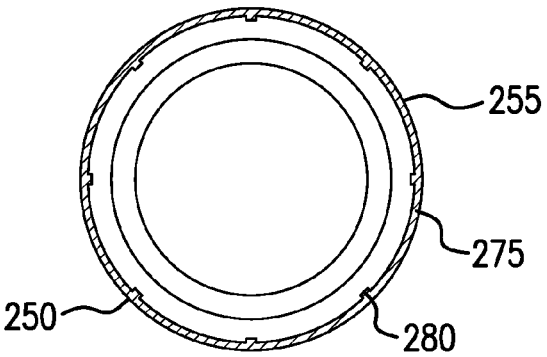
FIG. 2C depicts a top cross-section view of an exemplary cover assembly.

FIG. 2C depicts a top cross-section view of an exemplary cover assembly. The top cross-section of the cover assembly 205 is from the section B-B of FIG. 2A. The wall 255 has a first thickness 275 and a second thickness 280. The second thickness 280 is greater than the first thickness 275. The second thickness 280 defines the ribs 250. As such, the ribs 250 may contact an actuator to permit an air channel between the actuator and the wall 255 at the first thickness 275. As depicted, the ribs 250 are substantially equal distance from each other. In various embodiments, the ribs 250 may be of different distances from each other.

The sealing envelope 215 may include different shaped ribs 250. For example, the sealing envelope 215 may include ribs in a cross-shaped pattern disposed throughout the sealing envelope 215. In various embodiments, the actuator envelope 210 may also include ribs. Air channels or pockets created because of the ribs 250 may facilitate the removal of the cover assembly 205 from the actuator.

Figure 3:
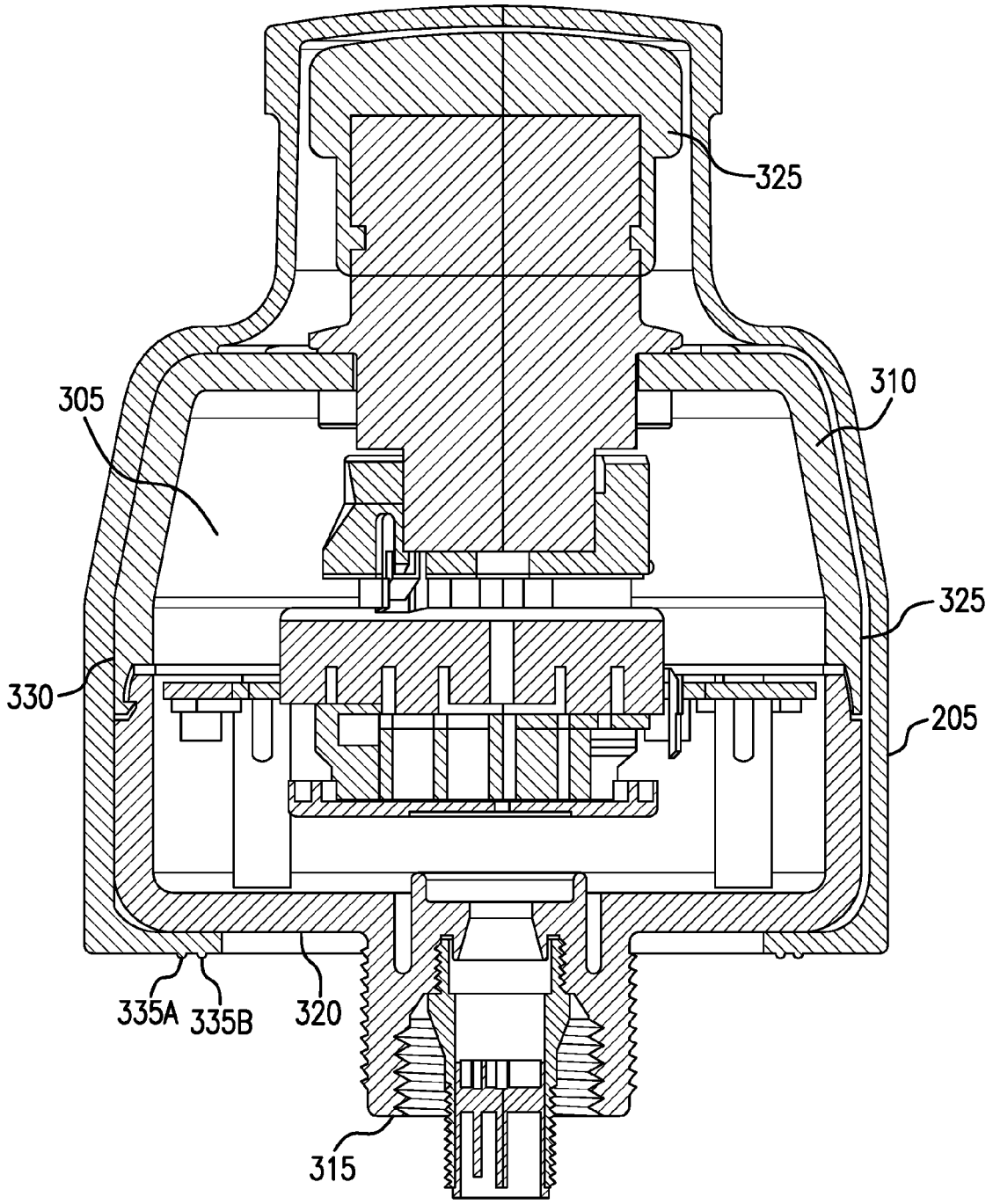
FIG. 3 depicts side cross-section view of an actuator enclosed by an exemplary cover assembly.

FIG. 3 depicts side cross-section view of an actuator enclosed by an exemplary cover assembly. The cover assembly 205 encloses an actuator 305, such as, for example, an emergency stop button. The actuator 305 includes an enclosure 310 that houses electro-mechanical components. A coupling interface 315, such as a threaded hub, for example, forms on a proximal surface 320 of the enclosure 310. A push button 325 operably attaches on top of the enclosure 310. The cover assembly 205 encloses the enclosure 310, the push button 325, and partially encloses the proximal surface 320.

The actuator 305 fills the cavity 260 of the cover assembly 205. The push button 325 occupies the actuator chamber 265 of the cavity 260 while the enclosure 310 occupies the actuator body chamber 270. As depicted, the cross-section view sections at one of the ribs 250 at one side of the cover assembly 205 and at the wall at an opposing side of the cover assembly 205. The cover assembly 205 flushes against the actuator 305 at 330. An air gap 325 forms between the cover assembly 205 and the actuator 305 due to an absence of one of the ribs 250. The ribs 250 may form multiple air gaps around the actuator 305. The sealing envelope 220 includes a pair of raised rings 335*a*-335*b* on its exterior surface. The raised rings 335*a*-335*b* may concentrate pressure when the actuator 305 is secured to a surface (e.g., the control station 110) to stop a high-pressure spray from entering the cover assembly 205.

In some embodiments, the actuator 305 may include an activation device, such as a switch, for example, that collinearly aligns with a top surface of the actuator body envelope 215. As such, the cover assembly 205 may not require a distinct actuator envelope 210 and actuator body envelope 215.

Figure 4:
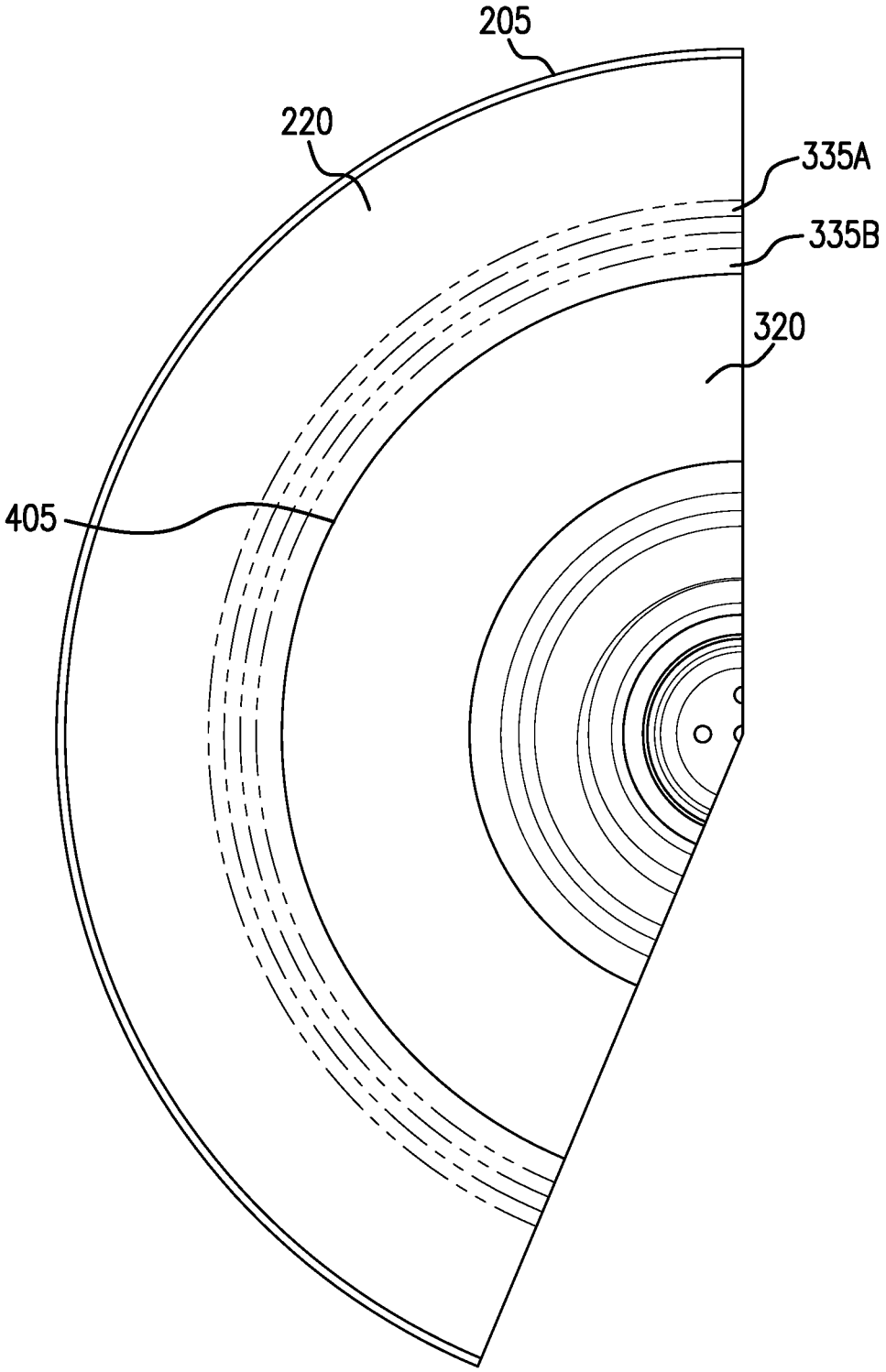
FIG. 4 depicts a partial bottom view of an actuator enclosed by an exemplary cover assembly.

FIG. 4 depicts a partial bottom view of an actuator enclosed by an exemplary cover assembly. The sealing envelope 220 of the cover assembly 205 partially extends to cover a portion of the proximal surface 320 of the actuator 305. The area of the proximal surface 320 not covered by the sealing envelope 220 may contact an installation surface, such as, for example, a surface of the control station 110. The raised rings 335*a*-335*b* may concentrate pressure when the actuator 305 is secured to a surface to prevent exposure to the proximal surface 320 against potentially detrimental substances.

The sealing envelope 220 forms an insertion aperture 405. A user may insert the actuator 305 through the insertion aperture 405 into the cavity 260. When the actuator 305 is fully inserted into the cavity 260, the sealing envelope 220 forms a seal against the proximal surface 320 of the actuator 305. The seal may protect the actuator 305 against high-pressure cleaning fluid up to 1450 pounds per inch. The insertion aperture 405 may stretch such that the proximal surface 320 of the actuator 305 passes through the insertion aperture 405 so that a user may peel off the cover assembly 205 from the actuator 305.

Figure 5A:
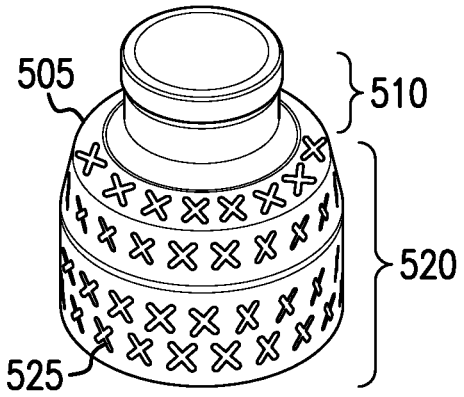
FIG. 5A depicts an isometric view of an exemplary cover assembly having ribs in a cross-shaped pattern.

FIG. 5A depicts an isometric view of an exemplary cover assembly having ribs in a cross-shaped pattern. A cover assembly 505 includes an actuator envelope 510, an actuator body envelope 515 and a sealing envelope (not shown). The actuator body envelope 515 includes a plurality of cross-shaped ribs 525 disposed about the actuator body envelope 515. As depicted, the ribs 525 are spaced apart but not continuous. The cross-shaped ribs 525 may decrease the likelihood of the cover assembly 505 rotating about an actuator.

Figure 5B:
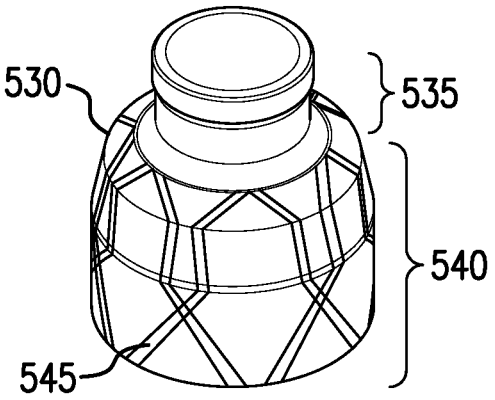
FIG. 5B depicts an isometric view of an exemplary cover assembly having elongated ribs that intersect each other.

FIG. 5B depicts an isometric view of an exemplary cover assembly having elongated ribs that intersect each other. An actuator envelope 535, an actuator body envelope 540, and a sealing envelope (not shown) form a cover assembly 530. The actuator body envelope 540 includes ribs 545 that extend from one end of the actuator body envelope 540 to another end of the actuator body envelope 540. As depicted, the ribs 545 intersect with each other. In some embodiments, the ribs 545 may extend into the sealing envelope. The ribs 545 may facilitate removal of the cover assembly 530 by creating air pockets at the sealing envelope.

Figure 5C:
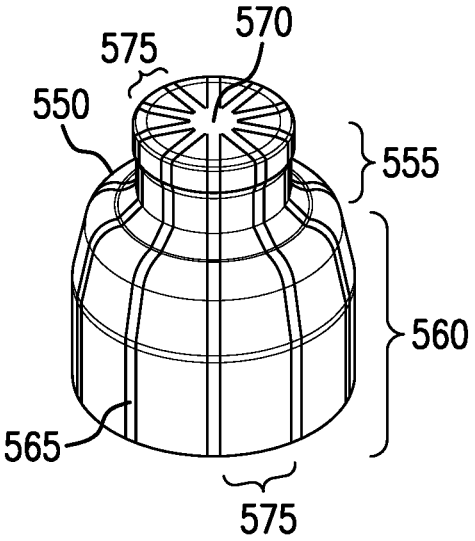
FIG. 5C depicts an isometric view of an exemplary cover assembly having substantially parallel ribs that extend from a top of the cover assembly to a bottom of the cover assembly.

FIG. 5C depicts an isometric view of an exemplary cover assembly having substantially parallel ribs that extend from a top of the cover assembly to a bottom of the cover assembly. A cover assembly 550 includes an actuator envelope 555 and an actuator body envelope 560. As depicted, ribs 565 extend axially from a point 570 of the actuator envelope 555 through the actuator body envelope 560. The ribs 565 may extend through a sealing envelope (not shown) of the cover assembly 550. The ribs 565 extending through the actuator envelope 555 and the actuator body envelope 560 may increase a resistance of the cover assembly 550 to high fluid pressure, such as water, for example, by creating more impact absorbing areas 575.

Figure 5D:
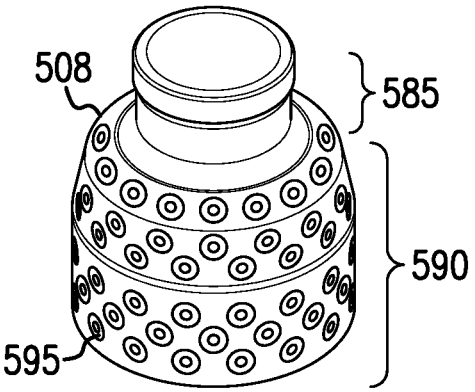
FIG. 5D depicts an isometric view of an exemplary cover assembly having circular ribs disposed on the body of the cover assembly.

FIG. 5D depicts an isometric view of an exemplary cover assembly having circular ribs disposed on the body of the cover assembly. A cover assembly 580, as depicted, includes an actuator envelope 585 and an actuator body envelope 590. The actuator body envelope 590 may include circular-shaped ribs 595. The circular-shaped ribs may increase the number of impact absorbing areas while decreasing the likelihood of slippage between an actuator and the cover assembly 580.

Figure 6A:
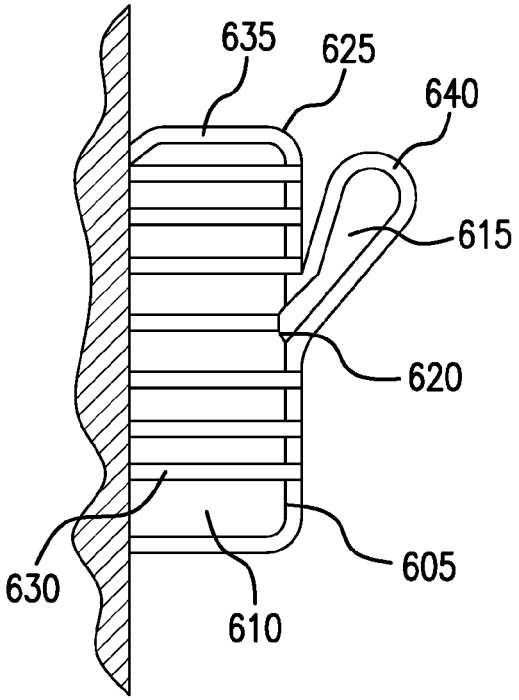
FIG. 6A depicts a side view of an exemplary cover assembly adapted to enclose a toggle switch.

FIG. 6A depicts a side view of an exemplary cover assembly adapted to enclose a toggle switch. An actuator 605 includes an enclosure 610 and a toggle switch 615. The enclosure 610 operably couples to a toggle switch 615 at a toggle point 620. As depicted, a cover assembly 625 having ribs 630 encloses the enclosure 610 and the toggle switch 615. The portion of the cover assembly 625 that encloses the toggle switch 615 may be adapted to deform relative to the position of the toggle switch 615. For example, the cover assembly 625 may include a greater wall thickness 635 along the cover assembly 625 enclosing the enclosure 610 than a wall thickness 640 along the cover assembly 625 enclosing the toggle switch 615. The greater wall thickness 635 may increase durability of the cover assembly 625 about the enclosure 610 while the wall thickness 640 may facilitate toggling of the toggle switch 615 about the toggle point 620.

Figure 6B:
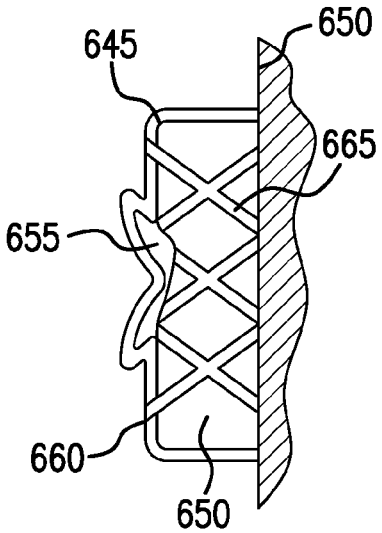
FIG. 6B depicts a side view of an exemplary cover assembly adapted to enclose a rocker switch.

FIG. 6B depicts a side view of an exemplary cover assembly adapted to enclose a rocker switch. An actuator 645 operably mounts to a surface 650 of a control station (e.g., control station 110). The actuator 645 includes an enclosure 650 operably coupled to a rocker switch 655. A cover assembly 660 encloses the actuator 645. The cover assembly 660 includes ribs 665. As depicted, the ribs 665 form X-type patterns along the wall of the cover assembly 660.

Although various embodiments have been described with reference to the Figures, other embodiments are possible. For example, the cover assembly 205 may be custom-fit to substantially protect against dust. The cover assembly 205 may resist ingress of high temperature (e.g., steam), high pressure cleaning such as 80-degree Celsius water sprayed at approximately 1160-1450 pounds per square inch (psi), for example. The cover assembly may resist ingress of water at a flow rate up to 16 liters per minute. As such, the cover assembly 205 may obtain a rating of IP69K for use in applications requiring high-pressure, high-temperature washdown to sanitize equipment.

In the embodiments of FIGS. 2-4, the ribs 250 may define contact points between the cover assembly 205 and the actuator 305. The area between the contact points may define impact absorbing areas of the cover assembly 205 to increase resilience of the cover assembly 205 against a high-pressure water cleaning. The impact absorbing areas may deform to cushion an impact from an external source, such as high pressured water, for example. The impact absorbing areas may define air pockets between the cover assembly 205 and the actuator 305. The air pockets may facilitate the removal of the cover assembly in the event direct access is needed to the actuator for maintenance or to replace the actuator 305, for example. A user may only desire the cover assembly 105 installed over the actuator during a cleaning cycle involving the use of high-pressure fluids and/or high-temperature fluids. In an illustrative example, the cover assembly 105 may only be removed for replacement or maintenance as the cover assembly 105 may protect the actuator 305 from contaminates.

The cover assembly 205 may be formed of various materials. For example, urethane may provide increased protection when the cover assembly 205 is used in environments where lubricating oils and automotive fuels may be present. Ethylene-propylene may form the cover assembly 205 to increase resistance to alcohols and detergents, for example.

The cover assembly 205 may be manufactured such that only a predetermined area of the cover assembly 205 is translucent. In an illustrative example, a bottom half of the actuator body envelope may be translucent. The cover assembly 205 may be entirely opaque. In some embodiments, a user may grasp the cover assembly 205 at a throat to easily remove the cover assembly 205 from an actuator 305. Ribs may be patterned in such a way to facilitate removing the cover assembly by the throat.

The cover assembly 205 may be formed to create a dust-tight fit when installed on a switch, such as, for example, the switch described in FIG. 1 of the U.S. patent application Ser. No. 14/168,845, titled "Switch", filed by Carlson et al. on Jan. 30, 2014, the entirety of the disclosure incorporated herein.

In the embodiments of FIGS. 5A-5D, the various configuration of the ribs 525, 545, 565, 595 may form different sized and shaped impact absorbing areas. For example, a situation may call for smaller circular shaped ribs (e.g., circular shaped ribs 595) while the ribs 565 may increase resistance against impact in a different application.

The actuator 305 may dictate the configuration of the ribs 250. In the embodiments of FIGS. 6A-6B, the actuators have a box-shaped enclosure (e.g., enclosure 610, 650) that may dictate the configuration of the ribs 250. For example, the box-shaped enclosure may receive impacts on a top surface (e.g., surface of enclosure 610 at which the toggle switch 615 operably couples). As such, the impact absorbing areas of the side walls of the box-shaped enclosure may require ribs (e.g., ribs 630) that form larger impact absorbing areas.

In an illustrative example, a compression molding process may form the cover assembly 205 from silicone, for example. Silicone may increase the chemical resistance and toughness of the cover assembly 205. Various molding processes such as extrusion, for example, may be used to form the cover assembly 205.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are contemplated.

What is claimed is:

1. A cover assembly to provide hygienic protection for electrical actuators in applications exposed to high-pressure washing, the cover assembly comprising:

an actuator envelope formed from a transparent non-toxic material and defining an actuator chamber;

a transparent non-toxic actuator body envelope formed from a transparent non-toxic material and integrally extending proximally from the actuator envelope and defining an actuator body chamber in fluid communication with the actuator envelope and in fluid communication with ambient atmosphere through an insertion aperture; and, a plurality of longitudinally extending ribs integrally formed within the actuator body envelope and extending radially inward from a substantially smooth interior surface of the actuator body envelope, wherein the actuator envelope and the actuator body envelope align along a longitudinal axis and together provide a unitary substantially smooth exterior surface to facilitate the removal of foreign particles when cleaned by a pressure wash, wherein when an electrical device, which comprises an actuator to receive a user input, and an actuator body to house an electrical circuitry responsive to the actuator, is removably inserted through the insertion aperture, the actuator is disposed in the body chamber, the actuator body envelope forms a seal against a proximal surface of the actuator; and, wherein the seal provides protection against the ingress of water up to a pressure of 1450 pounds per square inch.

2. The cover assembly of claim 1, further comprising a throat formed between an upper rim of the actuator envelope and the actuator body envelope, the throat having a minimum outside diameter that is less than an outside diameter of the upper rim taken at a proximal interface with the throat.

3. The cover assembly of claim 1, further comprising pressure equalization channels that provide fluid communication between the actuator chamber and the ambient atmosphere external to the actuator envelope when installing the actuator into the actuator body chamber.

4. The cover assembly of claim 1, further comprising pressure equalization channels that provide fluid communication between the actuator chamber and the ambient atmosphere external to the actuator envelope when removing the actuator from the actuator body chamber.

5. The cover assembly of claim 1, wherein the actuator body envelope provides protection against water up to 80-degrees Celsius.

6. The cover assembly of claim 1, wherein the actuator body envelope provides protection against fluid flow rate of up to 16 liters per minute.

7. The cover assembly of claim 1, wherein the substantially smooth unitary exterior surface is substantially free of crevices that can prevent removal of foreign particles when cleaned by a pressure wash.

8. The cover assembly of claim 1, wherein the actuator comprises an emergency stop button.

9. The cover assembly of claim 1, wherein the actuator comprises a toggle switch.

10. The cover assembly of claim 1, wherein the actuator comprises a rocker switch.

11. A cover assembly to provide hygienic protection for electrical actuators in applications exposed to high-pressure washing, the cover assembly comprising:

an actuator envelope defining an actuator chamber;

an actuator body envelope integrally extending proximally from the actuator envelope and defining an actuator body chamber in fluid communication with the actuator envelope and in fluid communication with ambient atmosphere through an insertion aperture; and, a plurality of longitudinally extending ribs integrally formed within the actuator body envelope and extending radially inward from a substantially smooth interior surface of the actuator body envelope, wherein the actuator envelope and the actuator body envelope align along a longitudinal axis and together provide a unitary substantially smooth exterior surface, wherein when an electrical device, which comprises an actuator to receive a user input, and an actuator body to house an electrical circuitry responsive to the actuator, is removably inserted through the insertion aperture, the actuator is disposed in the body chamber, the actuator body envelope forms a seal against a proximal surface of the actuator, and, wherein the seal provides protection against the ingress of water up to a pressure of 1450 pounds per square inch.

12. The cover assembly of claim 11, wherein the actuator body envelope provides protection against water up to 80-degrees Celsius.

13. The cover assembly of claim 11, wherein the actuator body envelope provides protection against fluid flow rate of up to 16 liters per minute.

14. The cover assembly of claim 11, wherein the substantially smooth unitary exterior surface is substantially free of crevices that can prevent removal of foreign particles when cleaned by a pressure wash.

15. The cover assembly of claim 11, wherein a translucent material forms the actuator envelope.

* * * * *